US007553803B2

(12) United States Patent
Korzenski et al.

(10) Patent No.: US 7,553,803 B2
(45) Date of Patent: Jun. 30, 2009

(54) ENHANCEMENT OF SILICON-CONTAINING PARTICULATE MATERIAL REMOVAL USING SUPERCRITICAL FLUID-BASED COMPOSITIONS

(75) Inventors: Michael B. Korzenski, Danbury, CT (US); Thomas H. Baum, New Fairfield, CT (US)

(73) Assignee: Advanced Technology Materials, Inc., Danbury, CT (US)

( * ) Notice: Subject to any disclaimer, the term of this patent is extended or adjusted under 35 U.S.C. 154(b) by 352 days.

(21) Appl. No.: 10/790,535

(22) Filed: Mar. 1, 2004

(65) Prior Publication Data

US 2005/0192193 A1 Sep. 1, 2005

(51) Int. Cl.

| | |
|---|---|
| ***C11D 7/50*** | (2006.01) |
| ***C11D 7/60*** | (2006.01) |
| ***C11D 3/43*** | (2006.01) |
| ***C11D 3/60*** | (2006.01) |
| ***C23G 5/02*** | (2006.01) |
| ***B08B 7/00*** | (2006.01) |

(52) U.S. Cl. ..... 510/175; 510/176; 510/421; 510/426; 510/432; 134/2; 134/3; 134/25.4; 134/41; 134/42

(58) Field of Classification Search ..... 510/175, 510/176, 421, 426, 432; 134/2, 3, 25.4, 41, 134/42

See application file for complete search history.

(56) References Cited

U.S. PATENT DOCUMENTS

| | | | | |
|---|---|---|---|---|
| 5,068,040 | A * | 11/1991 | Jackson | 210/748 |
| 5,676,705 | A | 10/1997 | Jureller | |
| 5,709,910 | A | 1/1998 | Argyle | |
| 5,866,005 | A * | 2/1999 | DeSimone et al. | 210/634 |
| 5,868,862 | A | 2/1999 | Douglas | |
| 5,962,390 | A * | 10/1999 | Flynn et al. | 510/286 |
| 6,306,564 | B1 | 10/2001 | Mullee | |
| 6,309,425 | B1 | 10/2001 | Murphy | |
| 6,500,605 | B1 | 12/2002 | Mullee | |
| 6,623,355 | B2 * | 9/2003 | McClain et al. | 451/60 |
| 6,669,785 | B2 | 12/2003 | DeYoung | |
| 6,735,978 | B1 | 5/2004 | Tom et al. | |
| 6,764,552 | B1 | 7/2004 | Joyce | |
| 6,777,337 | B2 * | 8/2004 | Yasui et al. | 438/692 |
| 6,800,142 | B1 | 10/2004 | Tipton | |
| 6,943,139 | B2 | 9/2005 | Korzenski | |
| 6,958,123 | B2 * | 10/2005 | Reid et al. | 216/2 |
| 6,989,358 | B2 | 1/2006 | Korzenski et al. | |
| 7,018,481 | B2 * | 3/2006 | Hayasaki et al. | 134/2 |
| 7,022,655 | B2 * | 4/2006 | Brask et al. | 510/175 |
| 7,044,143 | B2 * | 5/2006 | DeYoung et al. | 134/105 |
| 7,119,052 | B2 * | 10/2006 | Korzenski et al. | 510/175 |
| 2003/0125225 | A1 * | 7/2003 | Xu et al. | 510/175 |
| 2004/0087174 | A1 | 5/2004 | Korzenski et al. | |
| 2004/0087456 | A1 | 5/2004 | Korzenski | |
| 2004/0087457 | A1 | 5/2004 | Korzenski | |
| 2004/0171502 | A1 * | 9/2004 | Clark et al. | 510/175 |
| 2004/0224865 | A1 | 11/2004 | Roeder et al. | |
| 2004/0266635 | A1 | 12/2004 | Korzenski | |

OTHER PUBLICATIONS

H. Setyawan, et al., J. Aerosol Sci., 34, 923-936 (2003).
G.S. Selwyn, et al., J. Vac. Sci. Tech. A, 77, 2758-2765 (1989).
M. Olim, J. Electrochem. Soc., 144, 3657-3659 (1997).

* cited by examiner

*Primary Examiner*—Lorna M Douyon
(74) *Attorney, Agent, or Firm*—Chih-Sheng Lin; Tristan A. Fuierer; Moore & Van Allen, PLLC

(57) ABSTRACT

A method and composition for removing silicon-containing particulate material, such as silicon nitrides and silicon oxides, from patterned $Si/SiO_2$ semiconductor wafer surfaces is described. The composition includes a supercritical fluid (SCF), an etchant species, a co-solvent, a surface passivator, a binder, deionized water, and optionally a surfactant. The SCF-based compositions substantially remove the contaminating particulate material from the wafer surface prior to subsequent processing, thus improving the morphology, performance, reliability and yield of the semiconductor device.

56 Claims, 2 Drawing Sheets

ENHANCEMENT OF SILICON-CONTAINING PARTICULATE MATERIAL REMOVAL USING SUPERCRITICAL FLUID-BASED COMPOSITIONS

FIELD OF THE INVENTION

The present invention relates to supercritical fluid-based compositions containing polymeric alcohols such as polyvinyl alcohol, polymeric amines such as polyvinyl amine, and other polyalcohol or polyamine species, useful for the removal of silicon-containing particulate material, e.g., silicon nitrides and silicon oxides, generated in situ during plasma-assisted processes, from the surface of patterned semiconductor wafers.

DESCRIPTION OF THE RELATED ART

Particle contamination on the surface of semiconductor wafers is known to have deleterious effects on the morphology, performance, reliability and yield of the semiconductor device. For example, it has been reported that a particle larger than about one-quarter of the minimum line-width may cause fatal device defects. Clearly, with the continuing and rapid decrease in the critical dimensions of microelectronic device structures, the effective removal of particulates from the surface of semiconductor wafers is increasingly essential.

Well known sources of particle contamination during device production include plasma-assisted processes such as plasma-enhanced chemical vapor deposition (PECVD). The particle contamination may occur in situ during continuous plasma operation or following the termination of the plasma process (Setyawan, H., Shimada, M., Imajo, Y., Hayashi, Y., Okuyama, K., *J. Aerosol Sci.,* 34, 923-936 (2003); Selwyn, G. S., Singh, J., Bennett, R. S., *J. Vac. Sci. Tech. A,* 77, 2758-2765 (1989)). Because of the importance of the PECVD method for the fabrication of very large-scale integration (VLSI) circuits and thin-film transistors (TFTs), the future viability of the PECVD method, especially as critical dimensions continue to decrease, requires that the particles deposited during and/or at the termination of the PECVD process be removed prior to subsequent processing.

Traditional particle removal techniques used within the semiconductor industry include at least one of megasonic agitation, brush scrubbing, wet cleaning, and aerosol jet dry cleaning. Wet cleaning techniques utilize cleaning compositions such as ammonium hydroxide-hydrogen peroxide-water (APM, also referred to as "standard clean" 1 or SC-1) solutions to form soluble compounds of surface contaminants. A disadvantage of wet cleaning techniques include the disposal and/or treatment of large volumes of waste solvents following treatment of the wafer surface.

Megasonic agitation involves the application of energy in the 500-1000 kHz frequency range to the liquid in which particle-containing wafers are immersed (such as the APM solution) to remove said particles. Disadvantages of megasonic agitation include reports that the removal of particles smaller than 100 nm should not be theoretically possible (Olim, M., *J. Electrochem. Soc.,* 144, 3657-3659 (1997)), which renders the technique useless as the dimensions of the devices, and hence the contaminating particles, get smaller and smaller.

Aerosol jet dry cleaning uses solid water, carbon dioxide or argon particles in a high velocity gas stream to collide with and remove the contaminating particles from the surface. A disadvantage of aerosol jet dry cleaning includes the potential for dislodging delicate features, such as MEMS (Micro Electro Mechanical Systems) devices and wafer patterns, with the high velocity gas stream.

Recently, supercritical carbon dioxide ($SCCO_2$) compositions containing co-solvents have been used to enhance particle removal, both organic and inorganic in nature, from silicon and silicon dioxide regions of both blanketed and patterned wafers. However, compositions containing only $SCCO_2$ and alkanol co-solvents have proven to be incapable of removing 100% of the particulates from the wafer surface.

There is therefore a continuing need in the field for improved particle removal compositions and methods, since the removal of contaminating particulate material from semiconductor wafer surfaces is critical to ensure the production of semiconductor devices having exemplary performance, reliability and yields.

SUMMARY OF THE INVENTION

The present invention relates to supercritical fluid-based compositions useful for the removal of silicon-containing particulate material from the surface of patterned semiconductor wafers, and methods of using such compositions for removal of same.

In one aspect, the invention relates to a composition for removing silicon-containing particulate material from the surface of a semiconductor wafer, said composition comprising a supercritical fluid (SCF), at least one co-solvent, at least one etchant species, at least one surface passivator, a binder interactive with said silicon-containing particulate material to enhance removal thereof, deionized water, and optionally at least one surfactant.

In another aspect, the invention relates to a method of removing silicon-containing particulate matter from a semiconductor wafer surface having same thereon, said method comprising contacting the wafer surface with a SCF-based composition comprising a SCF, at least one co-solvent, at least one etchant species, at least one surface passivator, a binder interactive with said silicon-containing particulate material to enhance removal thereof, deionized water, and optionally at least one surfactant, for sufficient time and under sufficient contacting conditions to remove the silicon-containing particulate matter from the surface of the semiconductor wafer.

In yet another aspect, the invention relates to a composition for removing silicon-containing particulate material from the surface of a semiconductor wafer, said composition comprising about 85.0% to about 99.0% SCF, about 0.01% to about 15.0% co-solvent, about 0.25% to about 5.0% etchant, and optionally about 0% to about 3.0% surfactant, based on the total weight of the composition.

In a further aspect, the invention relates to a method of removing silicon-containing particulate matter from a semiconductor wafer surface having same thereon, said method comprising:

- pre-cleaning the wafer surface with a SCF-based pre-cleaning composition comprising a SCF and an aqueous-based pre-cleaning formulation; and
- contacting the wafer surface with a SCF-based composition comprising a SCF, at least one co-solvent, at least one etchant species, and optionally at least one surfactant, for sufficient time and under sufficient contacting conditions to remove the silicon-containing particulate matter from the surface of the semiconductor wafer.

Other aspects, features and embodiments of the invention will be more fully apparent from the ensuing disclosure and appended claims.

DETAILED DESCRIPTION OF THE INVENTION, AND PREFERRED EMBODIMENTS THEREOF

Figure 1:
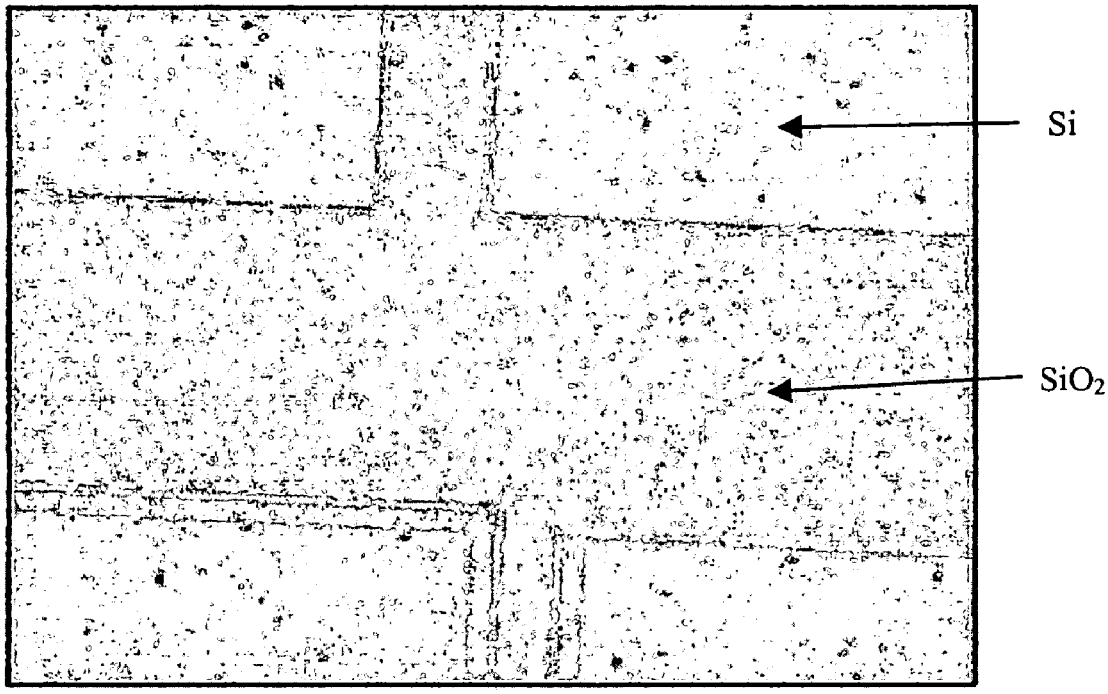
FIG. 1 is an optical image of the $Si/SiO_2$ patterned SONY control wafer contaminated with $Si_3N_4$ particles.

The present invention is based on the discovery of supercritical fluid (SCF)-based compositions that are highly efficacious for the removal of particulate material from the surface of patterned semiconductor wafers. The compositions and methods of the invention are effective for removing silicon-containing particulate material including, but not limited to, silicon nitride ($Si_3N_4$), silicon oxide and hydrogenated silicon nitride ($Si_xN_yH_z$), from the surface of patterned silicon-containing wafers, e.g., $Si/SiO_2$ wafers. The particulate material is generated in situ during plasma-assisted processes including, but not limited to, sputtering and PECVD.

The PECVD of silicon oxide films is often carried out using gaseous mixtures containing silane in nitrogen ($SiH_4/N_2$), nitrous oxide and ammonia. In addition to the deposition of silicon dioxide onto the substrate, highly hydrogenated silicon nitride particles are formed that can settle out onto the wafer surface, either during plasma operation or following the completion of the PECVD process. It is speculated that the source of the hydrogen on the surface of the silicon nitride particles is the silane precursor and/or the ammonia oxidant. In addition to silazane ($Si_2$—NH) groups at the surface of the silicon nitride particles, silanol (Si—OH) groups may also be present. The proportion of these functional groups on the surface of the silicon nitride particles varies according to the conditions under which the particles are generated.

Because of its readily manufactured character and its lack of toxicity and negligible environmental effects, supercritical carbon dioxide ($SCCO_2$) is a preferred SCF in the broad practice of the present invention, although the invention may be practiced with any suitable SCF species, with the choice of a particular SCF depending on the specific application involved. Other preferred SCF species useful in the practice of the invention include oxygen, argon, krypton, xenon, and ammonia. Specific reference to $SCCO_2$ hereinafter in the broad description of the invention is meant to provide an illustrative example of the present invention and is not meant to limit same in any way.

$SCCO_2$ is an attractive reagent for removal of particle contaminants, since $SCCO_2$ has the characteristics of both a liquid and a gas. Like a gas, it diffuses rapidly, has low viscosity, near-zero surface tension, and penetrates easily into deep trenches and vias. Like a liquid, it has bulk flow capability as a "wash" medium. $SCCO_2$ also has the advantage of being recyclable, thus minimizing waste storage and disposal requirements.

Ostensibly, $SCCO_2$ is an attractive reagent for the removal of $Si_3N_4$ particles, because both compounds are non-polar. However, neat $SCCO_2$ has not proven to be an effective medium for solubilizing silicon nitride particles. Furthermore, the addition of a polar co-solvent, e.g., alkanols, to the $SCCO_2$ has not substantially improved the solubility of the silicon nitride particles in the $SCCO_2$ composition. Accordingly, there is a continuing need to modify the $SCCO_2$ composition to enhance the removal of particulate material from the semiconductor wafer surface.

It is known that polymeric alcohols, such as polyvinyl alcohol, adsorb onto the surface of silicon nitride particles, thus lowering the surface potential of the particles. It is speculated that the silanol (Si—OH) and the silazane ($Si_2$—NH) groups at the surface of the silicon nitride particles participate in the transfer of protons in water to be Bronsted acid points, e.g., $H^+$ donation points, and Bronsted base points, e.g., $H^+$ receiving points. As such, the polyvinyl alcohol hydroxyl groups may adsorb onto the surfaces of the silicon nitride particles at the Bronsted acid points, thus enhancing the removal of the particles from the wafer surface. Additionally, hydrogen bonding between the polyvinyl alcohol hydroxyl groups and the silanol or silazane groups may participate in removal enhancement. Advantageously, once the contaminating particles are removed from the wafer surface, polyvinyl alcohol can stabilize the dispersion of silicon nitride particles in the fluid, thus minimizing flocculation.

The present invention combines the advantages associated with $SCCO_2$ and other SCFs, with the particle binding efficiency of polymeric alcohols such as polyvinyl alcohol, by using appropriately formulated SCF-based compositions as hereinafter more fully described. The removal of silicon nitride particles from a wafer surface using these SCF-based compositions is upwards of 100% efficient, while maintaining the structural integrity of the $Si/SiO_2$ layers.

In one aspect, the invention relates to SCF-based compositions useful in removing particulate contaminants including, but not limited to, silicon nitride, silicon oxide and hydrogenated silicon nitride, from a semiconductor wafer surface. The formulation of the present invention comprises a SCF, at least one co-solvent, at least one surface passivator, at least one etchant, a binder interactive with said silicon-containing particulate material to enhance removal thereof, deionized water, and optionally at least one surfactant, present in the following ranges, based on the total weight of the composition:

| component of | % by weight |
|---|---|
| SCF | about 75.0% to about 99.9% |
| co-solvent | about 0.05% to about 22.5% |
| surface passivator | about 0.01% to about 1.25% |
| etchant | about 0.01% to about 5.0% |
| binder | about 0.01% to about 3.75% |
| deionized (DI) water | about 0.01% to about 3.5% |
| surfactant | 0 to about 1.25% |

In the broad practice of the invention, the SCF-based etching formulations may comprise, consist of, or consist essentially of a SCF, at least one co-solvent, at least one surface passivator, at least one etchant, a binder interactive with said silicon-containing particulate material to enhance removal thereof, deionized water, and optionally at least one surfactant. In general, the specific proportions and amounts of SCF, co-solvent, surface passivator, etchant, binder, surfactant, and deionized water, in relation to each other, may be suitably varied to provide the desired removal of the silicon-containing particulate material from the wafer surface, as readily determinable within the skill of the art without undue effort.

The inclusion of the co-solvent with the SCF serves to increase the solubility of the binder in the SCF. The co-solvents contemplated for use in the SCF-based composition include alkanols, dimethylsulfoxide, sulfolane, catechol, ethyl lactate, acetone, butyl carbitol, monoethanolamine, butyrol lactone, an alkyl carbonate such as butylene carbonate, ethylene carbonate and propylene carbonate, a glycol amine such as N-methylpyrrolidone (NMP), N-octylpyrrolidone and N-phenylpyrrolidone, or a mixture of two of more of such species. The alkanol co-solvent is preferably a straight-chain or branched $C_1$-$C_6$ alcohol (i.e., methanol, ethanol, isopropanol, etc.), or a mixture of two or more of such alcohol species. In a preferred embodiment, the alkanol is methanol or isopropanol (IPA).

"Surface passivator" is defined herein as a substance that protects the wafer surface from additional oxidation, while simultaneously being capable of hydrogen bonding to the silicon-containing particulate surface to improve the removal of particles from the wafer surface. The surface passivator may comprise boric acid, triethyl borate and triethanolamine. In a preferred embodiment, the surface passivator is boric acid.

Species capable of etching silicon-containing species such as silicon nitride are well known in the art, and include hydrofluoric acid (HF), ammonium fluoride ($NH_4F$) and triethylamine trihydrofluoride ($(C_2H_5)_3N.3HF$). Additionally, salts of bifluorides may be used, including ammonium difluoride ($(NH_4)HF_2$), tetraalkylammonium difluorides ($(R)_4NHF_2$, where R is methyl, ethyl, butyl, phenyl or fluorinated $C_1$-$C_4$ alkyl groups) and alkyl phosphonium difluorides ($(R)_4PHF_2$, where R is methyl, ethyl, butyl, phenyl or fluorinated $C_1$-$C_4$ alkyl groups). The fluoride source aids in particle removal by chemically reacting with the silicon nitride and silicon oxide particles, undercutting the particles, thus reducing their size while concomitantly enhancing the ability of the binder to remove the particle from the wafer surface. In a preferred embodiment, the etchant is ammonium fluoride.

"Binders" are defined herein as species that interact with the silicon-containing particulate material to enhance removal from the semiconductor wafer. The binder may have moieties, e.g., hydroxyl or amine groups, capable of interacting with the Bronsted acid and/or Bronsted base points present on the surface of the contaminating particulate material. Additionally, the binders may be capable of hydrogen bonding with the surface of the silicon-containing particulate material. The combined effect of these intermolecular interactions is a reduction of the surface potential of the particulate material and concomitantly, the enhanced removal of the particulate material from the wafer surface. The binder of the present invention may be derived from at least one ethylenically unsaturated reactant. In a preferred embodiment, the binder is a polymeric alcohol, a polymeric amine, a polymeric acetate or a enzymatically decomposed sugar. In a particularly preferred embodiment, the polymeric alcohol is polyvinyl alcohol, which is commonly made by the polymerization of vinyl acetate followed by hydrolysis of the polyvinyl acetate polymer. In another particularly preferred embodiment, the polymeric amine is polyvinyl amine, which is commonly made from vinyl formamide.

The surfactants contemplated in the SCF-based composition of the present invention may include nonionic surfactants, such as fluoroalkyl surfactants, ethoxylated fluorosurfactants, polyethylene glycols, polypropylene glycols, polyethylene or polypropylene glycol ethers, carboxylic acid salts, dodecylbenzenesulfonic acid or salts thereof, polyacrylate polymers, dinonylphenyl polyoxyethylene, silicone or modified silicone polymers, acetylenic diols or modified acetylenic diols, and alkylammonium or modified alkylammonium salts, as well as combinations comprising at least one of the foregoing. In a preferred embodiment, the surfactant is an ethoxylated fluorosurfactant such as ZONYL® FSO-100 fluorosurfactant (DuPont Canada Inc., Mississauga, Ontario, Canada).

Alternatively, the surfactants may include anionic surfactants, or a mixture of anionic and non-ionic surfactants. Anionic surfactants contemplated in the SCF-based composition of the present invention include, but are not limited to, fluorosurfactants such as ZONYL® UR and ZONYL® FS-62 (DuPont Canada Inc., Mississauga, Ontario, Canada), sodium alkyl sulfates, ammonium alkyl sulfates, alkyl ($C_{10}$-$C_{18}$) carboxylic acid ammonium salts, sodium sulfosuccinates and esters thereof, e.g., dioctyl sodium sulfosuccinate, and alkyl ($C_{10}$-$C_{18}$) sulfonic acid sodium salts.

In one embodiment, the SCF-based composition of the invention includes $SCCO_2$, methanol, ammonium fluoride, boric acid, a fluorosurfactant, polyvinyl alcohol and deionized water.

In another aspect, the invention relates to methods of particulate material contaminant removal including, but not limited to, silicon nitride and silicon oxide, from a semiconductor wafer surface using the SCF-based composition described herein.

Particle removal by conventional wet chemical techniques, e.g., using SC-1 or SC-2 solutions, has not proven wholly satisfactory in effecting complete removal of particulate material from the wafer surface. Further, these conventional cleaning approaches require substantial amounts of chemical reagents and produce substantial quantities of chemical waste.

The SCF-based compositions of the present invention overcome the disadvantages of the prior art particle removal techniques by minimizing the volume of chemical reagents needed, thus reducing the quantity of waste, while simultaneously providing a composition and method having recyclable constituents, e.g., the SCFs.

The appropriate SCF-based composition can be employed to contact a wafer surface having particulate material contaminants, e.g., silicon nitride and silicon oxide, thereon at a pressure in a range of from about 1200 to about 4500 psi for sufficient time to effect the desired removal of the particulate matter, e.g., for a contacting time in a range of from about 2 minutes to about 20 minutes and a temperature of from about 30° C. to about 100° C., although greater or lesser contacting durations and temperatures may be advantageously employed in the broad practice of the present invention, where warranted. In a preferred embodiment, the contacting temperature is in the range of from about 40° C. to about 70° C., preferably about 50° C.

The removal process in a particularly preferred embodiment includes sequential processing steps including dynamic flow of the SCF-based composition over the contaminated wafer surface, followed by a static soak of the wafer in the SCF-based composition, with the respective dynamic flow and static soak steps being carried out alternatingly and repetitively, in a cycle of such alternating steps.

A "dynamic" contacting mode involves continuous flow of the composition over the wafer surface, to maximize the mass transfer gradient and effect complete removal of the particulate material from the surface. A "static soak" contacting mode involves contacting the wafer surface with a static volume of the composition, and maintaining contact therewith for a continued (soaking) period of time.

For example, the dynamic flow/static soak steps may be carried out for four successive cycles in the aforementioned illustrative embodiment, as including a sequence of 2.5 min-10 min dynamic flow, 2.5 min-5 min high pressure static soak, e.g., about 3000 psi to about 4500 psi, 2.5 min-10 min dynamic flow, and 2.5 min-10 min low pressure static soak, e.g., about 1200 psi to about 2900 psi. In a preferred embodiment, the sequence consists of a 2.5 min dynamic flow, a 2.5 min static soak at 4400 psi, a 2.5 min dynamic flow, and a 2.5 min static soak at 1500 psi.

Following the contacting of the SCF-based composition with the wafer surface, the wafer thereafter preferably is washed with copious amounts of SCF/methanol/deionized water solution in a first washing step, to remove any residual precipitated chemical additives from the region of the wafer surface in which particle removal has been effected, and finally with copious amounts of pure SCF, in a second washing step, to remove any residual methanol and/or precipitated chemical additives from the wafer surface. Preferably, the SCF used for washing is $SCCO_2$.

The SCF-based compositions of the present invention are readily formulated by simple mixing of ingredients, e.g., in a mixing vessel under gentle agitation.

Once formulated, such SCF-based compositions are applied to the wafer surface for contacting with the particulate material contaminants thereon, at suitable elevated pressures, e.g., in a pressurized contacting chamber to which the SCF-based composition is supplied at suitable volumetric rate and amount to effect the desired contacting operation for removal of the particulate material from the wafer surface.

It will be appreciated that specific contacting conditions for the SCF-based compositions of the invention are readily determinable within the skill of the art, based on the disclosure herein, and that the specific proportions of ingredients and concentrations of ingredients in the SCF-based compositions of the invention may be widely varied while achieving desired removal of the particulate material from the wafer surface.

In yet another aspect, the invention relates to a second SCF-based composition for particulate material, e.g., silicon nitride and silicon oxide, removal from a semiconductor wafer surface, said second SCF-based composition being devoid of the binder and surface passivator. The formulation comprises a SCF, at least one co-solvent, at least one etchant, and optionally at least one surfactant, present in the following ranges, based on the total weight of the composition:

| component of | % by weight |
|---|---|
| SCF | about 85.0% to about 99% |
| co-solvent | about 0.01% to about 15.0% |
| etchant | about 0.25% to about 5.0% |
| surfactant | 0 to about 3.0% |

The contemplated compositional components are the same as those disclosed hereinabove. In a particularly preferred embodiment, the SCF is $SCCO_2$, the co-solvent is NMP, the fluoride source is triethylamine trihydrofluoride and the surfactant is dioctyl sodium sulfosuccinate.

The methods of particulate material removal using the second SCF-based composition are the same as those disclosed hereinabove. Notably, the sample containing the particulate matter to be removed may have to be "pre-cleaned" prior to exposure to the second SCF-based composition to reoxidize the surface. An effective SCF-based "pre-cleaning" formulation includes 95-100 wt % $SCCO_2$ and 0-5 wt % aqueous-based pre-cleaning formulation, wherein the aqueous-based pre-cleaning formulation includes 0-10 vol % ammonium hydroxide, 0-20 vol % tertbutyl hydrogen peroxide and 70-95 vol % water. The pre-cleaning method includes a static soak of the sample in the SCF-based pre-cleaning formulation at pressures in a range from about 1200 psi to about 2800 psi and temperatures in a range from about 40° C. to about 60° C. for about 2 to about 30 minutes.

The features and advantages of the invention are more fully shown by the illustrative example discussed below.

The sample wafers examined in this study were $Si/SiO_2$ patterned wafers contaminated with $Si_3N_4$ particles. Various chemical additives, as described herein, were added to the SCF-based composition and particle removal efficiency evaluated. The temperature of the SCF-based composition was maintained at 50° C. throughout the particle removal experiments. Following particle removal, the wafers were thoroughly rinsed with copious amounts of $SCCO_2$/methanol/deionized water and pure $SCCO_2$ in order to remove any residual solvent and/or precipitated chemical additives. The results are shown in FIGS. 1-4, as described hereinbelow.

FIG. 1 is an optical image of the SONY control wafer showing $Si_3N_4$ particles covering the entire $Si/SiO_2$ wafer surface.

Figure 2:
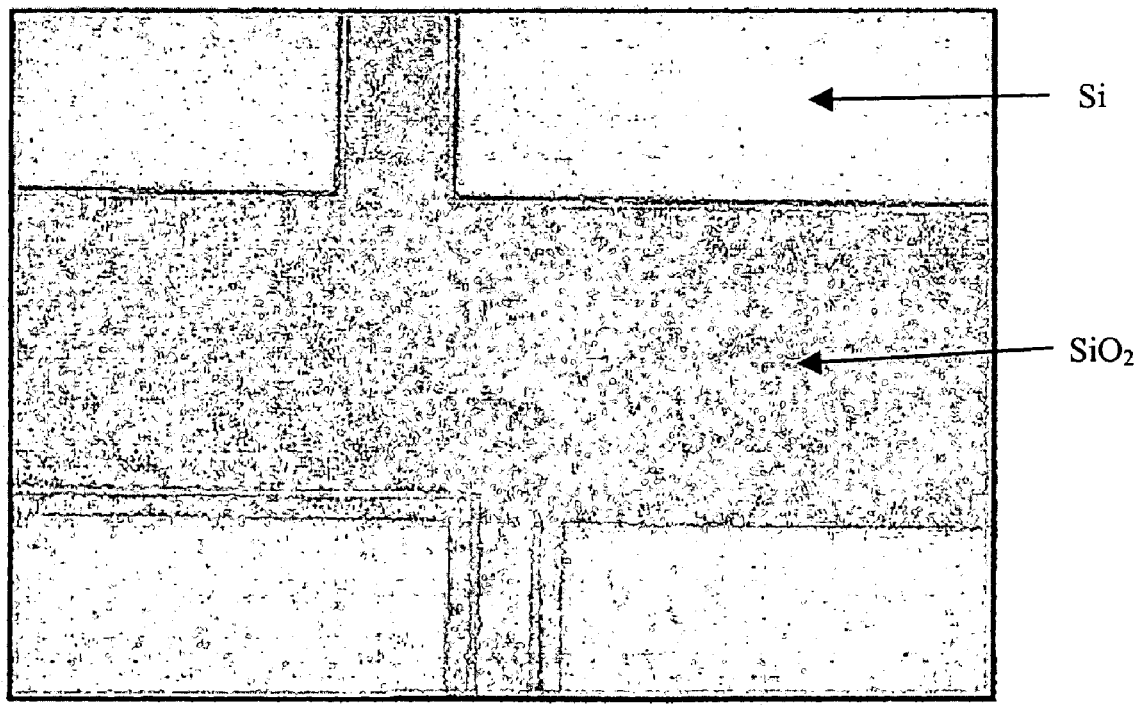
FIG. 2 is an optical image of the wafer of FIG. 1 cleaned at 50° C. with the SCF-based composition of the present invention, wherein the SCF-based composition is devoid of polyvinyl alcohol.

FIG. 2 is the same wafer cleaned with a $SCCO_2$/methanol/DI water/boric acid/$NH_4F$ solution, which is devoid of polyvinyl alcohol. The results show that the $Si_3N_4$ particles are completely removed from the $SiO_2$ surface, however, only approximately 50% of the particles were removed from the Si surface.

Figure 3:
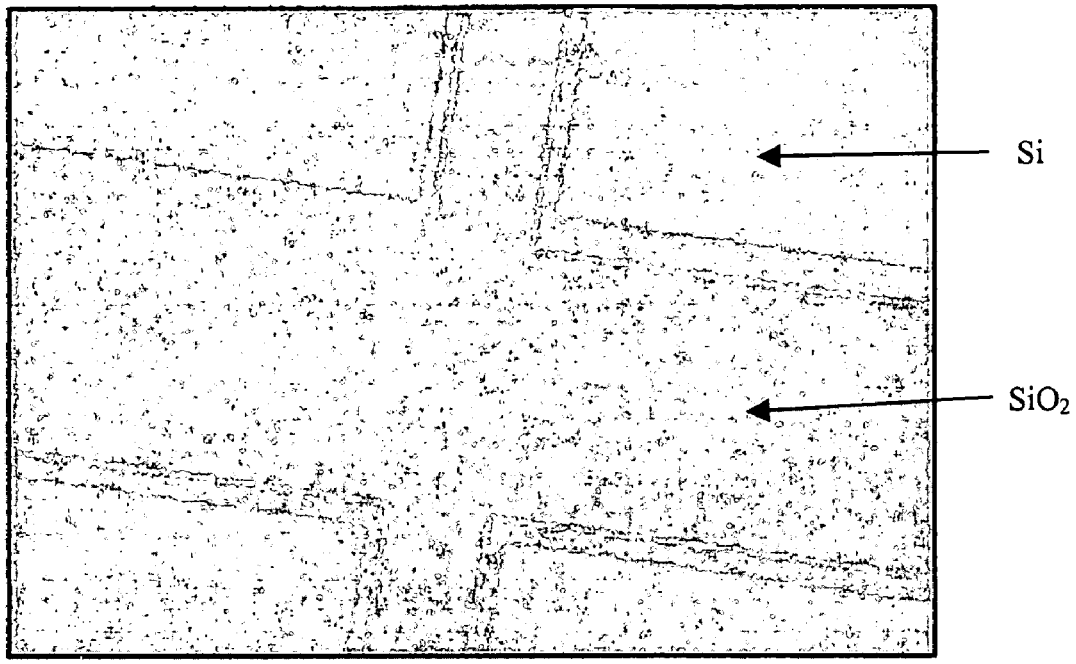
FIG. 3 is an optical image of the wafer of FIG. 1 cleaned at 50° C. with the SCF-based composition of the present invention, wherein the SCF-based composition includes polyvinyl alcohol and has a high fluoride concentration.

FIG. 3 is the same wafer cleaned with a $SCCO_2$/methanol/DI water/boric acid/$NH_4F$/polyvinyl alcohol solution having a fluoride/boric acid ratio of 3:1 (high fluoride concentration). The results clearly show that the $Si_3N_4$ particles are completely removed from the $SiO_2$ surface, while leaving the particles residing on the silicon regions untouched. However, because the fluoride:boric acid ratio was so high, severe etching of the $SiO_2$ surface occurs, wherein the etch rate was about 50 Å $min^{-1}$.

Figure 4:
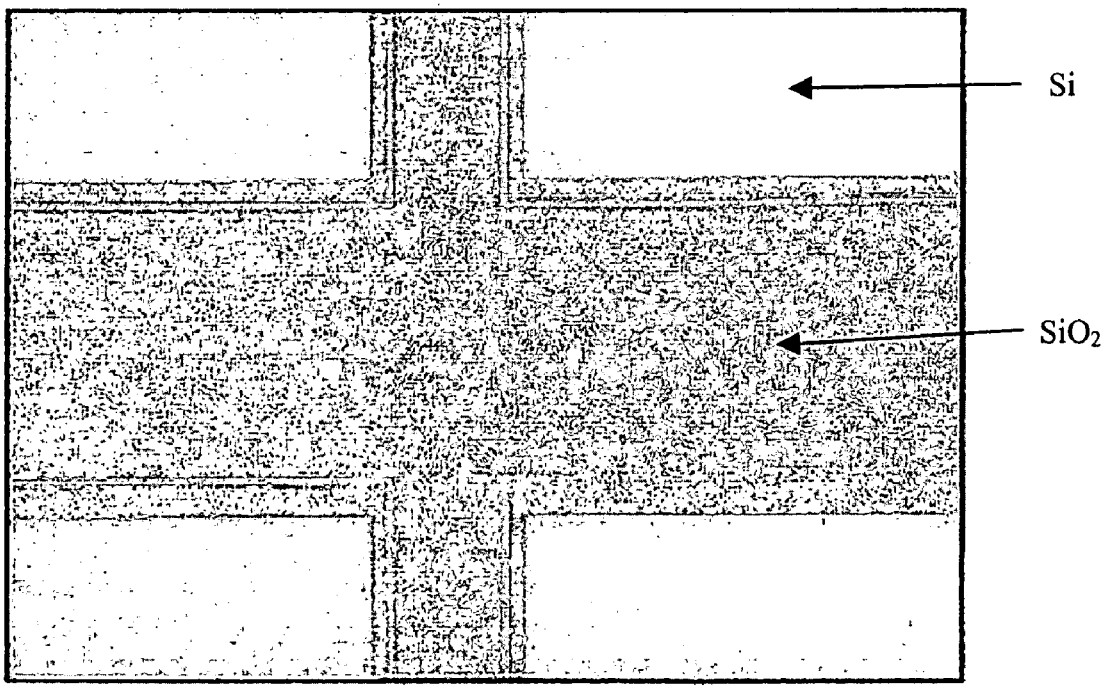
FIG. 4 is an optical image of the wafer of FIG. 1 cleaned at 50° C. with the SCF-based composition of the present invention, wherein the SCF-based composition includes polyvinyl alcohol and has a low fluoride concentration.

FIG. 4 is the same wafer cleaned with a $SCCO_2$/methanol/DI water/boric acid/$NH_4F$/polyvinyl alcohol solution having a low fluoride concentration. The results clearly show that the $Si_3N_4$ particles are completely removed from both the Si and $SiO_2$ surfaces, with no evidence of $SiO_2$ etching.

The above-described photographs thus evidence the efficacy of SCF-based compositions in accordance with the invention, for removal of silicon-containing particulate material, e.g., silicon nitride particles, from wafer surfaces.

The following formulation resulted in substantial removal of silicon nitride particles from the patterned $Si/SiO_2$ surface. "Substantial removal" is defined as greater than about 98% removal of the particulate material from the semiconductor device, as determined by optical microscopy. In this specific embodiment, 100% cleaning of the particles was observed in all areas in 4 minutes at 50° C.

| Component | Weight Percent |
|---|---|
| ammonium fluoride | 0.036% |
| boric acid | 0.053% |
| ZONYL ® FSO-100 fluorosurfactant | 0.12% |
| polyvinyl alcohol | 0.53% |
| methanol | 7.92% |
| DI water | 3.36% |
| $SCCO_2$ | 87.98% |

Another formulation found to substantially remove particles at lower pressures, e.g., 2800 psi, and 50° C. includes:

| Component | Weight Percent |
|---|---|
| triethylamine trihydrofluoride | 0.1% |
| dioctyl sodium sulfosuccinate | 0.02% |
| NMP | 10.0% |
| $SCCO_2$ | 89.88% |

Accordingly, while the invention has been described herein in reference to specific aspects, features and illustrative embodiments of the invention, it will be appreciated that the utility of the invention is not thus limited, but rather extends to and encompasses numerous other aspects, features and embodiments. Accordingly, the claims hereafter set forth are intended to be correspondingly broadly construed, as including all such aspects, features and embodiments, within their spirit and scope.

What is claimed is:

1. A supercritical fluid (SCF) based composition comprising at least one co-solvent, at least one etchant species, at least one surface passivator, a binder interactive with silicon-containing particulate material to enhance removal thereof, water, and optionally at least one surfactant, wherein said binder is derived from at least one ethylenically unsaturated reactant, wherein said etchant species is selected from the group consisting of hydrofluoric acid, ammonium fluoride, triethylamine trihydrofluoride, ammonium bifluoride, tetraalkylammonium bifluorides having the formula $(R)_4NHF_2$ and alkyl phosphonium bifluorides having the formula $(R)_4PHF_2$, wherein R is selected from the group consisting of methyl, ethyl, butyl, phenyl and fluorinated $C_1$-$C_4$ alkyl groups, wherein said composition is useful for removing silicon-containing particulate material from the surface of a semiconductor wafer, and wherein the surface passivator is selected from the group consisting of boric acid and triethyl borate.

2. The composition of claim 1, wherein the SCF-based composition comprises a SCF selected from the group consisting of carbon dioxide, oxygen, argon, krypton, xenon, and ammonia.

3. The composition of claim 2, wherein the SCF is carbon dioxide.

4. The composition of claim 1, wherein the co-solvent comprises at least one solvent selected from the group consisting of alkanols, dimethylsulfoxide, sulfolane, catechol, ethyl lactate, acetone, butyl carbitol, monoethanolamine, butyrol lactone, propylene carbonate, butylene carbonate, ethylene carbonate, N-methylpyrrolidone, N-octylpyrrolidone, N-phenylpyrrolidone, and a mixture of two or more of such species.

5. The composition of claim 1, wherein the co-solvent comprises at least one $C_1$-$C_6$ alkanol.

6. The composition of claim 1, wherein the co-solvent comprises methanol.

7. The composition of claim 1, wherein the silicon-containing particulate material comprises silicon nitride.

8. The composition of claim 1, wherein the silicon-containing particulate material comprises silicon oxide.

9. The composition of claim 1, wherein the etchant species is ammonium fluoride.

10. The composition of claim 1, wherein the composition comprises a surfactant.

11. The composition of claim 10, wherein the surfactant comprises at least one surfactant selected from the group consisting of fluoroalkyl surfactants, ethoxylated fluorosurfactants, polyethylene glycols, polypropylene glycols, polyethylene ethers, polypropylene glycol ethers, carboxylic acid salts, dodecylbenzenesulfonic acid, dodecylbenzenesulfonic salts, polyacrylate polymers, dinonylphenyl polyoxyethylene, silicone polymers, modified silicone polymers, acetylenic diols, modified acetylenic diols, alkylammonium salts, modified alkylammonium salts, and combinations comprising at least one of the foregoing.

12. The composition of claim 10, wherein the surfactant comprises at least one anionic surfactant selected from the group consisting of fluorosurfactants, sodium alkyl sulfates, ammonium alkyl sulfates, alkyl ($C_{10}$-$C_{18}$) carboxylic acid ammonium salts, sodium sulfosuccinates and esters thereof, and alkyl ($C_{10}$-$C_{18}$) sulfonic acid sodium salts.

13. The composition of claim 10, wherein the surfactant comprises an ethoxylated fluorosurfactant.

14. The composition of claim 1, wherein the interactions between the binder and the silicon-containing particulate material comprise intermolecular interactions selected from the group consisting of hydrogen bonding and van der Waals forces.

15. The composition of claim 1, wherein the binder comprises a polyvinyl alcohol derived from at least one ethylenically unsaturated reactant.

16. The composition of claim 1, wherein the binder comprises a polyvinyl amine derived from at least one ethylenically unsaturated reactant.

17. The composition of claim 1, wherein the interactions between the binder and the silicon-containing particulate material reduce the silicon-containing particulate material count on the surface of the semiconductor wafer.

18. The composition of claim 1, wherein the surface passivator is boric acid.

19. The composition of claim 1, wherein the composition comprises about 75.0% to about 99.9% SCF, about 0.05% to about 22.5% co-solvent, about 0.01% to about 5.0% etchant, about 0.01% to about 1.25% surface passivator, about 0.01% to about 3.75% binder, 0% to about 1.25% surfactant and about 0.01% to about 3.5% deionized water, based on the total weight of the composition.

20. The composition of claim 19, wherein the ratio of etchant to surface passivator is about 2:3 to about 4:3.

21. The composition of claim 1, wherein the surface passivator is triethyl borate.

22. The composition of claim 1 further comprising silicon-containing particulate material.

23. A composition comprising a supercritical fluid (SCF), silicon-containing paritculate material residue, a surface passivator selected from the group consisting of boric acid and triethyl borate, and a binder interactive with said silicon-containing particulate material to enhance removal thereof, wherein said binder comprises a polymeric species derived from at least one ethylenically unsaturated reactant, said polymeric species selected from the group consisting of a polymeric alcohol and a polymeric amine, and wherein said composition is useful for removing silicon-containing particulate material from the surface of a semiconductor wafer.

24. The composition of claim 23, wherein the silicon-containing particulate material residue comprises a species selected from the gorup consisting of silicon nitride, silicon oxide, and hydrogenated silicon nitride.

25. A method of removing silicon-containing particulate matter from a semiconductor wafer surface having same thereon, said method comprising contacting the wafer surface with a SCF-based composition comprising at least one co-solvent, at least one etchant species, at least one surface passivator, a binder interactive with said silicon-containing particulate matter to enhance removal thereof, water, and optionally at least one surfactant, for sufficient time and under sufficient contacting conditions to remove the silicon-containing particulate matter from the surface of the semiconductor wafer, wherein said binder is derived from at least one ethylenically unsaturated reactant, and wherein the surface passivator is selected from the group consisting of boric acid and triethyl borate.

26. The method of claim 25, wherein the SCF-based composition comprises an SCF selected from the group consisting of carbon dioxide, oxygen, argon, krypton, xenon, and ammonia.

27. The method of claim 26, wherein the SCF is carbon dioxide.

28. The method of claim 25, wherein the contacting conditions comprise pressures in a range of from about 1200 to about 4500 psi.

29. The method of claim 25, wherein said contacting time is in a range of from about 4 minutes to about 20 minutes.

30. The method of claim 25, wherein the co-solvent comprises at least one solvent selected from the group consisting of alkanols, dimethylsulfoxide, sulfolane, catechol, ethyl lactate, acetone, butyl carbitol, monoethanolamine, butyrol lactone, propylene carbonate, butylene carbonate, ethylene carbonate, N-methylpyrrolidone, N-octylpyrrolidone, N-phenylpyrrolidone, and a mixture of two or more of such species.

31. The method of claim 25, wherein the co-solvent comprises at least one $C_1$-$C_6$ alcohol.

32. The method of claim 25, wherein the silicon-containing particulate matter comprises silicon nitride.

33. The method of claim 32, wherein the silicon nitride particles are generated during plasma-enhanced chemical vapor deposition (PECVD) of a silicon-containing material at the semiconductor wafer surface.

34. The method of claim 25, wherein the silicon-containing particulate matter comprises silicon oxide.

35. The method of claim 25, wherein the etchant species is selected from the group consisting of hydrofluoric acid, ammonium fluoride, triethylamine trihydrofluoride, ammonium bifluoride, tetraalkylammonium bifluorides having the formula $(R)_4NHF_2$ and alkyl phosphonium bifluorides having the formula $(R)_4PHF_2$, wherein R is selected from the group consisting of methyl, ethyl, butyl, phenyl and fluorinated $C_1$-$C_4$ alkyl groups.

36. The method of claim 25, wherein the etchant species comprises ammonium fluoride.

37. The method of claim 25, wherein the SCF-based composition further comprises a surfactant.

38. The method of claim 37, wherein the surfactant comprises at least one surfactant selected from the group consisting of fluoroalkyl surfactants, ethoxylated fluorosurfactants, polyethylene glycols, polypropylene glycols, polyethylene ethers, polypropylene glycol ethers, carboxylic acid salts, dodecylbenzenesulfonic acid, dodecylbenzenesulfonic salts, polyacrylate polymers, dinonylphenyl polyoxyethylene, silicone polymers, modified silicone polymers, acetylenic diols, modified acetylenic diols, alkylammonium salts, modified alkylammonium salts, and combinations thereof.

39. The method of claim 37, wherein the surfactant comprises at least one anionic surfactant selected from the group consisting of fluorosurfactants, sodium alkyl sulfates, ammonium alkyl sulfates, alkyl ($C_{10}$-$C_{18}$) carboxylic acid ammonium salts, sodium sulfosuccinates and esters thereof, and alkyl ($C_{10}$-$C_{18}$) sulfonic acid sodium salts.

40. The method of claim 25, wherein the interactions between the binder and the silicon-containing particulate matter comprise intermolecular interactions selected from the group consisting of hydrogen bonding and van der Waals forces.

41. The method of claim 25, wherein the binder comprises polyvinyl alcohol derived from at least one ethylenically unsaturated reactant.

42. The method of claim 25, wherein the binder comprises polyvinyl amine derived from at least one ethylenically unsaturated reactant.

43. The method of claim 25, wherein the polyvinyl alcohol adsorbs to silazane ($Si_2$—NH) and/or silanol (Si—OH) groups at the surface of the silicon-containing particulate matter.

44. The method of claim 25, wherein the surface passivator is boric acid.

45. The method of claim 25, wherein the SCF-based composition comprises about 75.0% to about 99.9% SCF, about 0.05% to about 22.5% co-solvent, about 0.01% to about 5.0% etchant, about 0.01% to about 1.25% surface passivator, about 0.01% to about 3.75% binder, 0% to about 1.25% surfactant and about 0.01% to about 3.5% deionized water, based on the total weight of the composition.

46. The method of claim 25, wherein the contacting step comprises a cycle including (i) dynamic flow contacting of the SCF-based composition with the wafer surface containing the silicon-containing particulate material, and (ii) static soaking contacting of the SCF-based composition with the wafer surface containing the silicon-containing particulate material.

47. The method of claim 46, wherein said cycle comprises alternatingly and repetitively carrying out dynamic flow contacting and static soaking contacting of the wafer surface containing the silicon-containing particulate matter.

48. The method of claim 25, wherein the contacting conditions comprise temperatures in a range from about 30° C. to about 100° C.

49. The method of claim 25, wherein the contacting conditions comprise temperatures in a range from about 40° C. to about 70° C.

50. The method of claim 25, further comprising the step of washing the wafer surface, at a region at which the silicon-containing particulate material have been removed, with a SCF/methanol/deionized water wash solution in a first washing step, and with a SCF in a second washing step, to remove residual precipitated chemical additives in said first washing step, and to remove residual precipitated chemical additives and/or residual alcohol in said second washing step.

51. The method of claim 50, wherein the SCF is $SCCO_2$.

52. The method of claim 25, wherein the SCF-based composition further comprises silicon-containing particulate matter.

53. A method of removing silicon-containing particulate matter from a semiconductor wafer surface having same thereon, said method comprising:

pre-cleaning the wafer surface with a SCF-based pre-cleaning composition comprising supercritical carbon dioxide ($SCCO_2$) and an aqueous-based pre-cleaning formulation, wherein the aqueous-based pre-cleaning formulation comprises an oxidizing agent and the $SCCO_2$ comprises at least 95 wt % of the SCF-based pre-cleaning composition, based on the total weight of the pre-cleaning composition; and contacting the wafer surface with a SCF-based composition comprising $SCCO_2$, N-methylpyrollidone (NMP), triethylamine trihydrofluoride, and dioctyl sodium sulfosuccinate, for sufficient time and under sufficient contacting conditions to remove the silicon-containing particulate matter from the surface of the semiconductor wafer.

54. A method of removing silicon-containing particulate matter from a semiconductor wafer surface having same thereon, said method comprising:

pre-cleaning the wafer surface with a SCF-based pre-cleaning composition comprising supercritical carbon dioxide ($SCCO_2$) and an aqueous-based pre-cleaning formulation, wherein the aqueous-based pre-cleaning formulation comprises ammonium hydroxide, t-butyl hydrogen peroxide and water and the $SCCO_2$ comprises at least 95 wt % of the SCF-based pre-cleaning composition, based on the total weight of the pre-cleaning composition; and contacting the wafer surface with a SCF-based composition comprising a SCF, at least one co-solvent, at least one etchant species, and optionally at least one surfactant, for sufficient time and under sufficient contacting conditions to remove the silicon-containing particulate matter from the surface of the semiconductor wafer.

55. The method of claim 54, wherein the wafer surface is pre-cleaned in a pressure range from about 1200 psi to about 2900 psi.

56. The method of claim 54, wherein the wafer surface is pre-cleaned in a temperature range from about 40° C. to about 60° C.

* * * * *